US005648766A

United States Patent [19]

Stengel et al.

[11] Patent Number: 5,648,766

[45] Date of Patent: Jul. 15, 1997

[54] CIRCUIT WITH SUPPLY VOLTAGE OPTIMIZER

[75] Inventors: Robert E. Stengel, Ft. Lauderdale; David L. Muri, Sunrise, both of Fla.

[73] Assignee: Motorola, Inc., Schaumburg, Ill.

[21] Appl. No.: 352,302

[22] Filed: Dec. 8, 1994

Related U.S. Application Data

[63] Continuation of Ser. No. 812,926, Dec. 24, 1991, abandoned.

[51] Int. Cl.[6] ..... G08C 19/04

[52] U.S. Cl. ..... 340/870.39; 455/343; 331/57

[58] Field of Search ..... 340/870.39; 331/57; 323/283; 455/38.3, 343

[56] References Cited

U.S. PATENT DOCUMENTS

| | | | |
|---|---|---|---|
| 4,236,199 | 11/1980 | Stewart | 331/57 |
| 4,358,728 | 11/1982 | Hashimoto | 331/57 |
| 4,439,692 | 3/1984 | Beekmans et al. | 307/296.2 |
| 4,553,047 | 11/1985 | Pillinger et al. | 307/296.8 |
| 4,988,960 | 1/1991 | Tomisawa | 331/57 |
| 5,095,226 | 3/1992 | Tani | 307/296.6 |
| 5,107,138 | 4/1992 | Seki et al. | 307/296.6 |
| 5,162,668 | 11/1992 | Chen et al. | 307/296.8 |

*Primary Examiner*—John K. Peng
*Assistant Examiner*—Andrew Hill
*Attorney, Agent, or Firm*—M. Mansour Ghomeshi

[57] ABSTRACT

An electronic device (100) includes a regulator (102) for generating an operating voltage. The device (100) also includes at least one component (110) using the operating voltage and requiring a minimum input voltage for proper operation. The device (100) further includes a sensor (115) for sensing the minimum input voltage of the component (110) to produce a minimum operating voltage. Also included in the device (100) is a feedback circuit (116), responsive to the sensor (115), for feeding the minimum operating voltage to the regulator (102) whereby the regulator (102) alters the output voltage to the level of the minimum operating voltage.

6 Claims, 4 Drawing Sheets

CIRCUIT WITH SUPPLY VOLTAGE OPTIMIZER

This is a continuation of application Ser. No. 07/812,926, filed on Dec. 24, 1991 and now abandoned.

TECHNICAL FIELD

This invention relates generally to electronic devices and more specifically to electronic devices employing microprocessors.

BACKGROUND

As microprocessor technology dominates the electronic industry, more and more devices are taking advantage of their high processing power and flexibility. It is well known that as the speed, which is directly proportional to the processing power of microprocessors, increases, so does the current consumption at a set voltage. Battery operated devices, by their nature, treat their supply current very conservatively, in order to save their valuable battery energy.

Generally, microprocessor operated devices include a regulator that regulates the operating voltage to levels appropriate for the proper operation of their various elements. These regulated voltages are chosen with sufficient safety margins to provide regulated supply voltage to all the active components under extreme conditions as demanded by environmental changes and processing speed. These safety margins render the regulated voltage much higher than required for normal operation, resulting in significant unnecessary loss of battery energy. This loss of energy becomes more appreciable as the number of active elements relying on the supply voltage increases. Circuit designers are forced to increase their operating voltages to insure proper operation for all the worst case conditions. It is therefore desired to have an electronic device that can optimize the energy consumption without compromising or sacrificing performance.

SUMMARY OF THE INVENTION

Briefly, according to the invention, an electronic device having an operating voltage is provided. The device includes a regulator means for generating the operating voltage and also includes at least one component using the operating voltage and declining a minimum input voltage for proper operation. The device includes a sensor means for sensing the minimum input voltage of the at least one component to produce a minimum operating voltage. Also included in the device is a feedback means responsive to the sensor means for feeding the minimum operating voltage to the regulator means whereby the regulator means alters the output voltage to the level of the minimum operating voltage.

DETAILED DESCRIPTION OF THE PREFERRED EMBODIMENT

Electronic devices using regulators as means of regulating their operating voltages are normally designed to have their regulated voltage set higher than worst case operating conditions as defined by the manufacturers of their various components. This regulated voltage is often higher than the level required by the instantaneous operating condition of the device because of margins that the designer must consider for environmental changes and manufacturing process variations. The higher voltages on which regulators operate result in wasted energy. The principles of the present invention provide a solution for minimizing this wasted energy.

Figure 1:
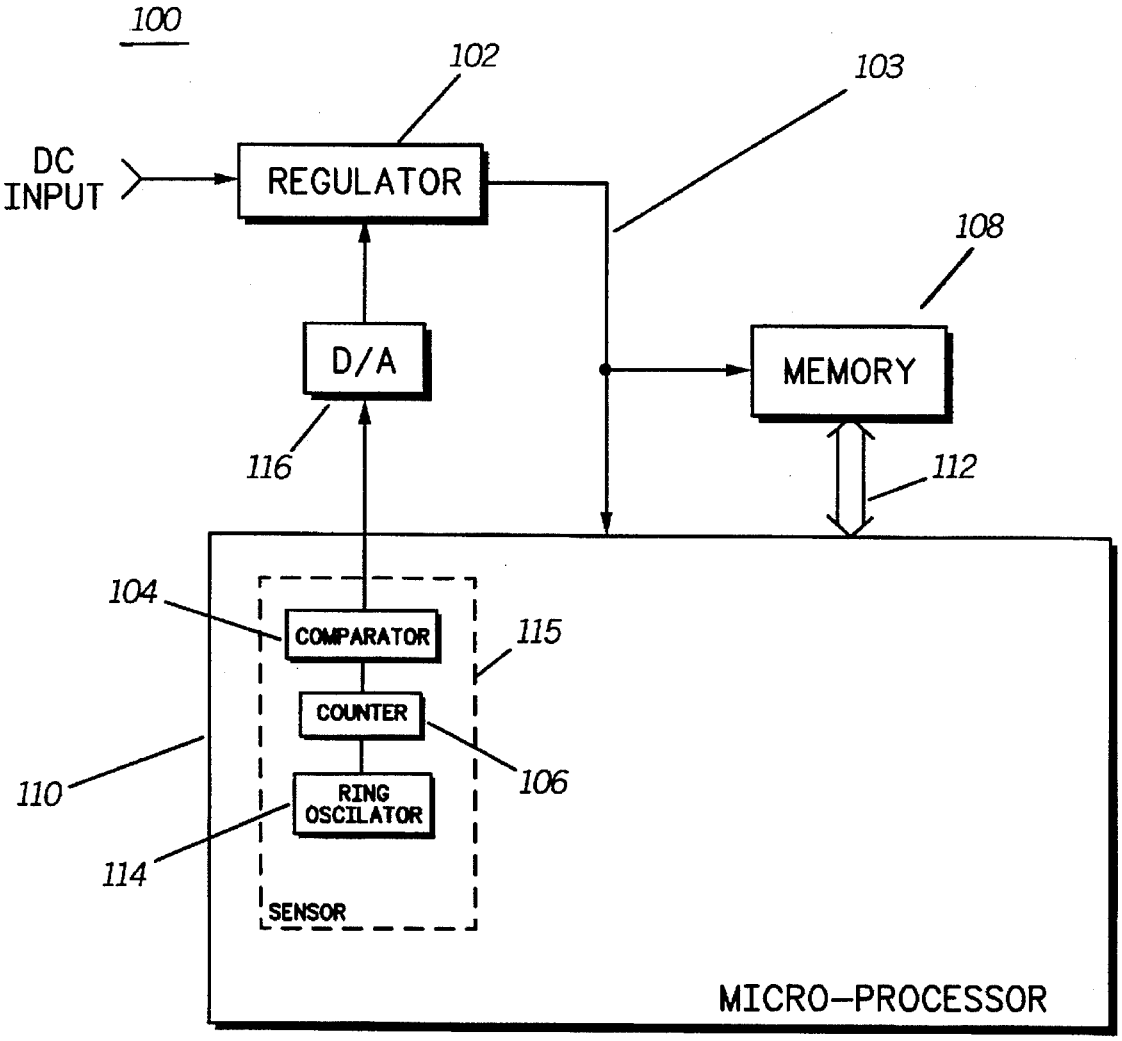
FIG. 1 shows a block diagram of an electronic device in accordance with the principles of the present invention.

Referring now to FIG. 1, a block diagram of an electronic device 100 in accordance with the present invention is shown. The operating voltage for the device 100 is provided by a regulator 102 on supply line 103. The input signal for the regulator 102 is preferrably provided by a battery or any other supply source. In its simplest form, the device 100 includes a micro-processor 110 and a memory component 108. The memory component 108 may be a Random Access Memory (RAM), a Read Only Memory (ROM), or any other memory component. The micro-processor 110 controls the operation of the device 100. Other components may be included in the device 100 and coupled to the supply line 103, however, for the presentation of the objectives of the present invention and in order to avoid unnecessary complications such components have been eliminated. The communication between the memory 108 and the micro-processor 110 is provided via address, control, and data lines, collectively shown by 112. In the preferred embodiment, the operating program for the micro-processor 110 is stored in the memory 108. Various portions of the operating program, hereinafter referred to as instructions or program routines, are fetched from the memory 108 and executed by the micro-processor 110. The maximum operating speed associated with each of these program routines is also stored in the memory 108 preceding each file. This maximum speed information assists the micro-processor 110 in determining the minimum operating voltage.

The micro-processor 110 includes a ring oscillator 114, a counter 106, and a comparator 104, all fabricated using the same technology used in the fabrication of the micro-processor 110.

The combination of the ring oscillator 114, the counter 106, and the comparator 104 provide a sensor 115 for sensing changes in the environmental conditions. In the preferred embodiment, the sensor 115 is used to detect when the regulated voltage on the supply line 103 is at its optimum level under the prevailing environmental conditions and the operating speed of the micro-processor 110.

The sensor 115 is turned ON under the command of the micro-processor 110. It is well known in the art that the operating frequency of ring oscillators is predominantly determined by the operating voltage, the fabrication process, and the environmental conditions. The principles of the present invention take the relationship between the operating voltage and the operating frequency of the ring oscillator 114 to determine the most optimum operating voltage for the micro-processor 110. In fact, the frequency of the ring oscillator 114 provides valuable information on the adequacy of the operating voltage. By calibrating the frequency of the ring oscillator 114 with the speed with which the micro-processor will run its next file, one can accurately predict the adequacy of the operating voltage.

The counter 106 is used to measure the operating frequency of the ring oscillator 114. The comparator 104 compares the oscillator frequency with the maximum speed information stored in the memory 108. The result of this comparison determines the next level of the operating voltage.

The output of the comparator 104 is coupled to the regulator 102 via a feedback circuit, preferrably a digital-to-analog converter 116. The output of the comparator 104 is converted to analog before being applied to the regulator 102 where it works to adjust the regulated voltage on the supply line 103, appropriately. This process is repeated until the output voltage at the supply line 103 reaches a minimum operating voltage. A flow chart of the operation of the micro-processor 110 in conjunction with the regulator 102 is shown in FIG. 2.

Figure 2:
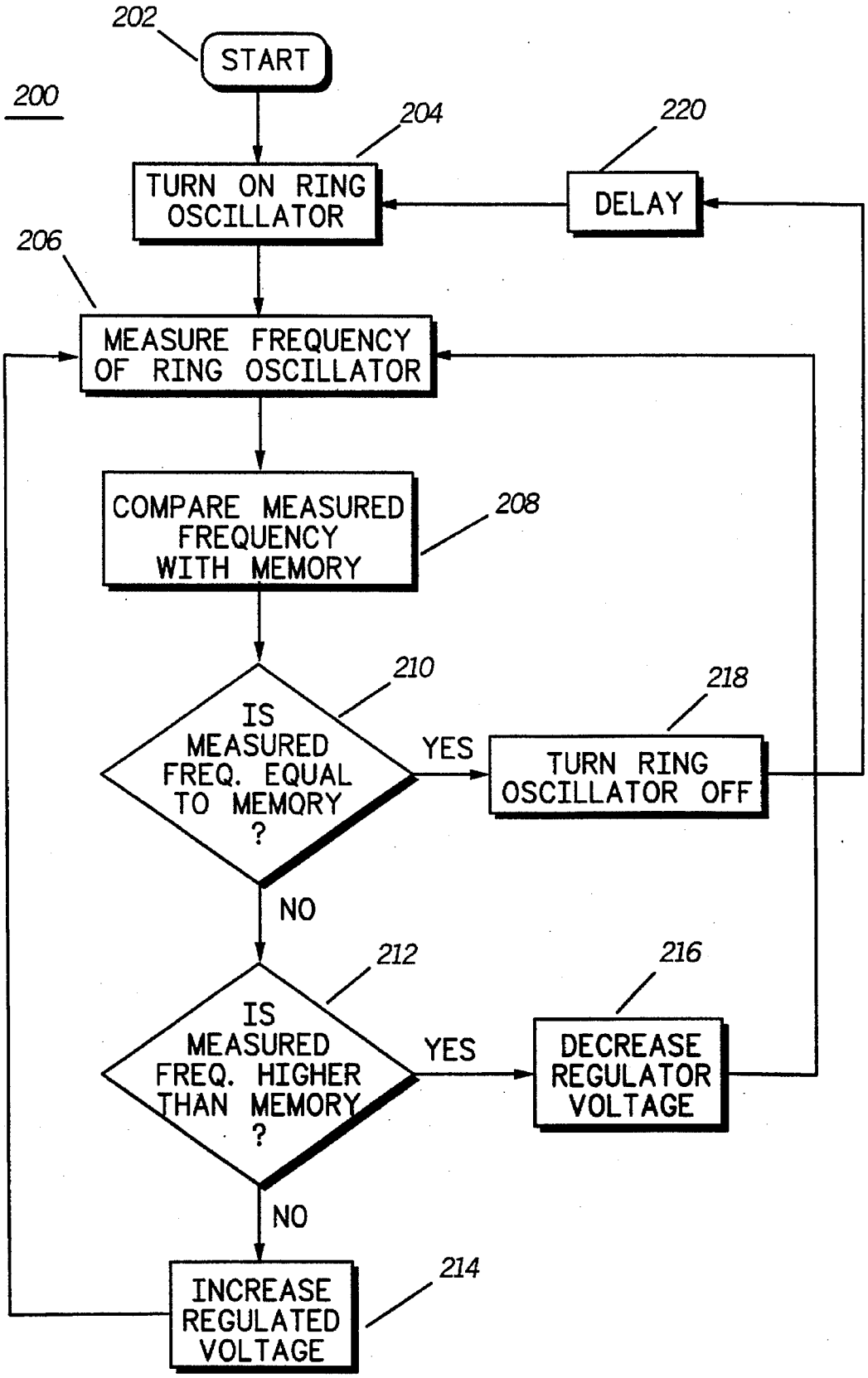
FIG. 2 shows a flow chart of the operation of an energy saving scheme in accordance with the present invention.

Referring to FIG. 2, a flow chart of the operation of the micro-processor 110 in accordance with the present invention is shown. From a start block 202 the operation is coupled to block 204 where the components of the sensor 115 are turned ON. The frequency of the ring oscillator 114 is then measured (block 206). The measured frequency is compared with the highest operating frequency stored in the memory (block 208). As stated earlier, this stored value represents the highest speed the micro-processor 110 is required to operate in order to execute the next program routine. The output of block 208 is coupled to a condition block 210, where a decision is made as to whether the measured frequency is equal to the stored value. The NO output is coupled to a second condition block 212 where a decision is made as to whether the measured frequency is higher than the stored value. The NO output of the second condition block 212 indicates that the supply voltage is too low since the ring oscillator 114 is not running at a speed that the micro-processor 110 will have to run in order to execute the next batch of files. Therefore, the regulator 102 is directed to increase the operating voltage (block 214). Once the regulator voltage is increased, the operation returns to block 206 where the frequency of the ring oscillator 114 is once again measured. This cycle of comparing the measured frequency and evaluating the comparison result with stored information is repeated until such time that the condition block 210 produces a YES output.

The YES output of the condition block 212 indicates that the operating voltage is higher than what is required by the micro-processor, for the ring oscillator 114 is operating at a higher frequency than the micro-processor 110 will have to in order to execute its next batch of files. This output is therefore coupled to block 216 where the regulator 102 is directed to produce a lower operating voltage. The output of the decrease regulator voltage, block 216 is returned back to block 206 where once again the frequency of the ring oscillator is measured. The loop consisting of blocks 206, 208, 210, 212 is repeated until the measured frequency of the ring oscillator is equal to the stored value resulting in the YES output of condition block 210. This YES output results in turning the sensor 115 OFF, block 218. With the ring oscillator OFF, a delay is introduced, block 220 before the sensor 115 is once again turned ON to repeat the cycle of measuring the frequency and determining whether the operating voltage can be decreased further or must be increased in order to execute the next batch of files.

The flow chart 200 may be executed for optimum voltage conditions before each program routine is executed. The frequency of execution of the flow chart 200 depends on the amount of energy desired to be saved.

The combination of a comparator, counter, and a ring oscillator must be added to all the compatible components of the device 100 to insure proper operation. Upon start-up, the micro-processor 110 proceeds to determine which of the components poses the worst case scenario for the operating voltage. With this information known to the system the flow chart 200 is repeated for that particular component every time a change in operating speed is expected. In other words, the memory 108, for instance, will include a ring oscillator, a comparator, and a counter. Under the command of the micro-processor 110, the these components are turned on and the frequency of the ring oscillator is compared with a known value. A determination is made as to whether the memory 108 requires the worst case higher voltage or the micro-processor 110 requires the worst case higher voltage. Depending on the result of this determination, the next execution of the flow chart 200 will be implemented in that particular component. This assures proper operation of the device 100 by allowing the worst component to dictate the lowest operating voltage. This may be repeated for as many components as there are in the device 100. Note that the addition of a ring oscillator, a comparator, and a counter is not significant as compared to the architecture of a micro-processor or a memory device. These items occupy small areas with insignificant current consumption.

Figure 3:
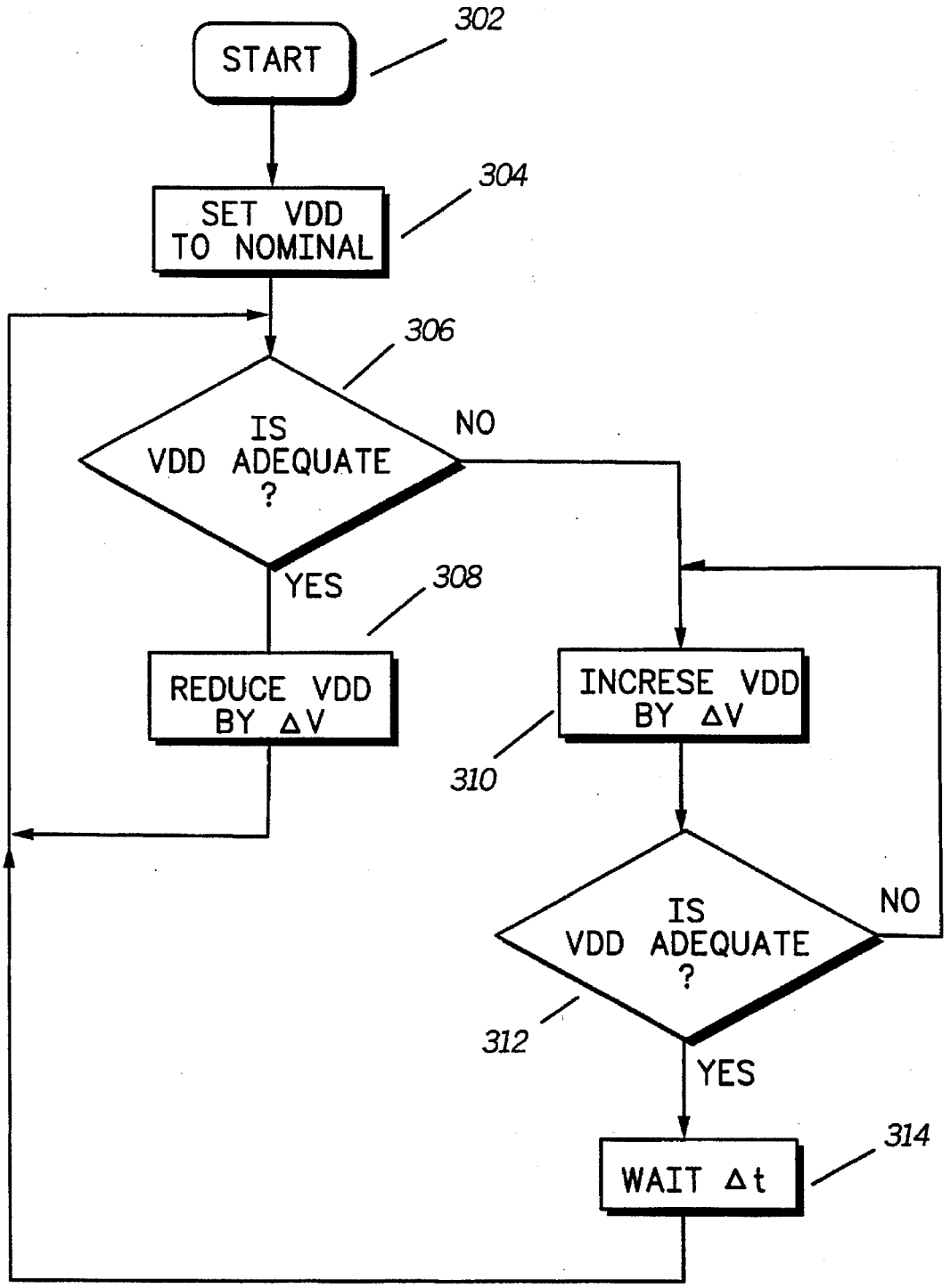
FIG. 3 shows a flow chart of an alternative embodiment of the present invention.

Referring now to FIG. 3, an alternative embodiment of the present invention is shown utilizing software steps to achieve a similar result. From a start block 302, the supply voltage or VDD is set to a nominal value (block 304). This block is followed by a condition block 306 where a decision is made as to whether VDD is adequate. The YES output is coupled to a "reduce VDD by ΔV" block 308. The ΔV by which the VDD is reduced is a voltage differential sufficient to allow the regulator to increase or decrease its output voltage without bypassing an optimum operating window. The NO output of the condition block 306 is coupled to increase VDD by ΔV block 310 which is followed by a condition block 312. The condition block 312 decides whether VDD is adequate. The NO output returns to block 310 where the VDD is once again increased by ΔV. This cycle is continued until VDD is adequate which results in the YES output of block 312. The YES output of block 312 is coupled to a block 314 where the operation halts for a period of ΔT. This delay allows the operation to continue for a period of time before the cycle is repeated. The output of block 314 is coupled to the condition block 306 where the cycle is once again repeated.

Figure 4:
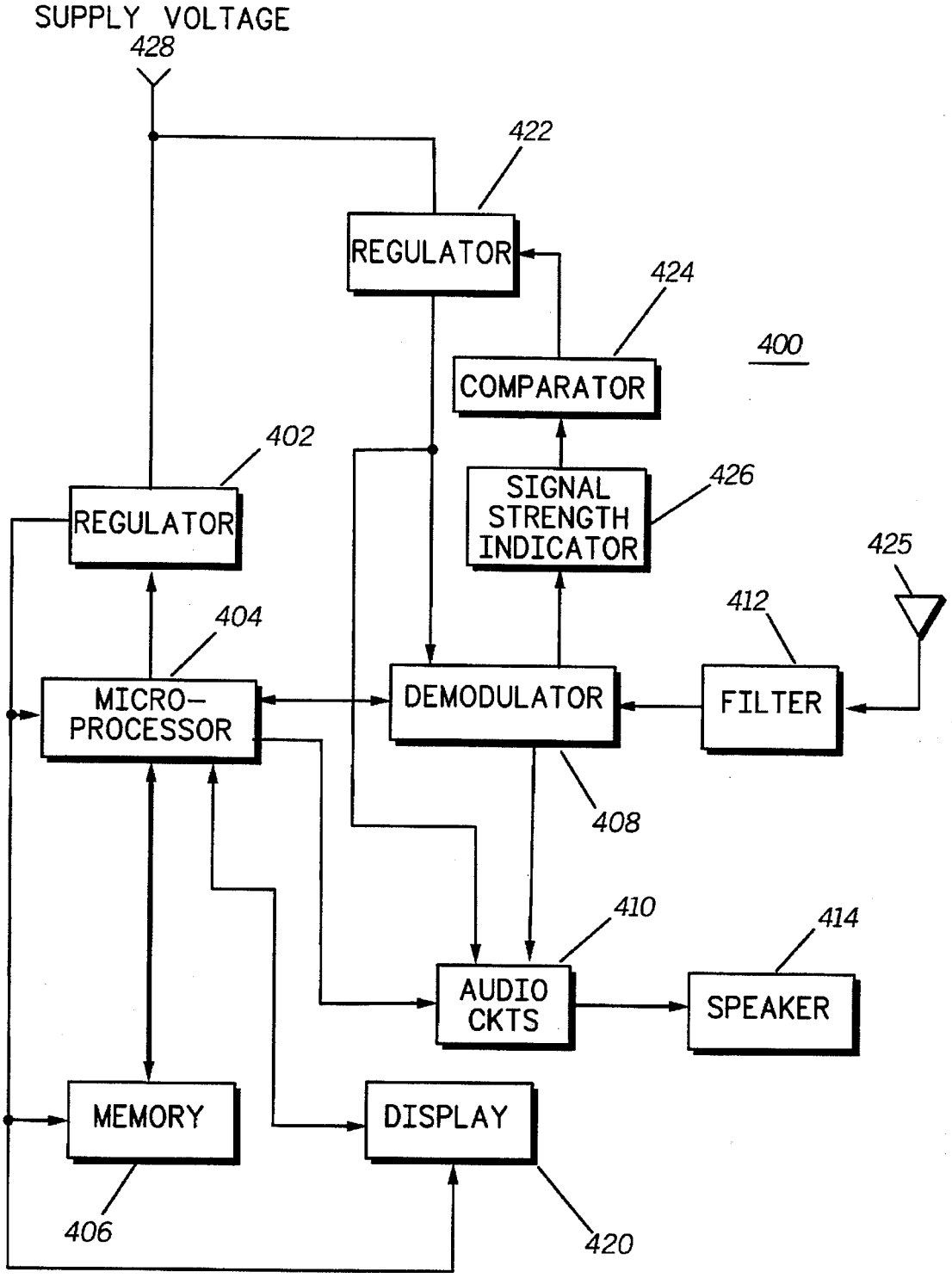
FIG. 4 shows a communication device in accordance with the present invention.

Referring now to FIG. 4, a block diagram of a communication device is shown in accordance with the present invention. The communication device 400 includes a micro-processor 404 which controls the operation of the device 400. The micro-processor 404 establishes the at least one component of the communication device 400. The device 400 also includes a memory component 406 and a display 420. A first regulator 402 generates the first operating voltage for the micro-processor 404, the memory block 406, and the display 420. In general, the first regulator 402 provides operating voltage for the digital components of the device 400. Note that all these digital components may have a sensor similar to the sensor 115 as described in conjunction with the device 100. An input voltage 428 provides the supply voltage for the regulator 402. A polling routine may be initially conducted by the micro-processor 404 to determine the component with the highest operating voltage requirements.

An antenna 425 is provided to receive radio frequency signals where they are coupled to a filter 412 for selectivity. The output of the filter 412 is coupled to a demodulator 408 where received signals are demodulated and decoded. The demodulator 408 provides the at least one additional component of the device 400. A second regulator 422 provides regulated voltage to the demodulator 408, and in general the analog components of the device 400. The input voltage 428 provides the supply voltage for the regulator 422. An audio circuit block 410 receives the audio portion of the demodulated signals from the demodulator 408. These signals are then processed and presented to the user via a speaker 414. A sensor, preferably a signal strength indicator 426 is coupled to the demodulator 408. Wide band and narrow band signal strength levels are measured at the indicator 426 and coupled to a comparator 424. The comparator 424 compares the wide and narrow band signal strength levels and applies the result back to the regulator 422. The regulator 422 proceeds to alter the second operating voltage, accordingly. Note that similar techniques may be implemented on the audio circuit block 410 or any other analog components in the device 400. Such a technique would provide for a determination of the minimum operating voltages for all the analog components of the device 400. These minimum voltage levels am then wire-ORed to the regulator 422. The regulator 422 adjusts its output voltage to meet the operating voltage requirements set by the component with the highest minimum operating voltage requirements.

Data components of the demodulated signals are sent to the micro-processor 404 where they are decoded and coupled to a display 420. The display 420 may be used to inform the user of the prevailing level of the operating voltage. The micro-processor 404 once again, includes a comparator, a counter, and a ring oscillator similar to that explained in conjunction with the micro-processor 110. The regulated voltage of the regulator 402 is increased or decreased to reach optimum levels by allowing the ring oscillator to operate and generate a frequency representative of the voltage level, fabrication intricacies, and environmental conditions. This frequency is subsequently measured by the counter and compared to a fixed value by the comparator. This operation results in optimizing the regulated voltage in order to save energy and consume as little current as possible. The savings of current associated with this scheme are substantial considering that manufacturers of various electronic components specify operating parameters under worst case scenarios. These worst case scenarios include environmental conditions and process variations. Utilizing the principles of the present invention the designer of electronic circuits can go beyond the manufacturers' specification in setting a dynamic operating voltage. As environmental conditions change, so does the operating voltage to provide compensation therefor.

By dynamically changing the regulator voltage optimum operating conditions may be achieved without depending on manufacturing operating voltage requirements. These optimal conditions provide for a significant reduction in consumed energy, highly desirable in battery operated devices.

In summary, a micro-processor would have a function test to be used as feedback for determining accepted performance for a given supply voltage. As present efficient voltage regulators utilize static voltage or current feedback to maintain a constant output voltage, this characteristic can be used to change the operating voltage of the regulator. The speed performance of a ring oscillator is utilized versus its supply voltage in order to set the output voltage level of a switching voltage regulator or a linear voltage regulator. One can achieve an optimum supply voltage condition from one device to another. In essence, the comparator compares the frequency of the ring oscillator with a number that represents the highest operating speed of the microprocessor in order to execute its next batch of files. After the initial set-up, the ring oscillator frequency is frequently monitored in order to detect environmental changes, such as temperature, humidity, etc.. This information is used in the preferred embodiment to update the switching regulator output voltage.

A significant benefit of the present invention is that by using a ring oscillator, a counter, and a comparator a sensor may be formed to detect environmental condition changes. The detection of these changes with such minimal circuitry is highly beneficial to the operation of devices containing the sensor. In the preferred embodiment this sensor provides a scheme for reducing the battery consumption associated with various electronic components. The amount of reduction is a function of the specific component test function capability in the application environment. Thus providing the maximum battery reduction by using a functional test circuit of performance feedback to set the lowest operating voltage. The functional test is designed to measure performance without causing device malfunction or discontinued operation requiring system reset or power on initialization.

By periodically allowing a micro-processor to analyze its operation and the operation of other blocks in an electronic device, the operating voltage conditions may be optimized in order to reduce current consumption. By executing the operation of the flow chart 200 at opportune moments a significant saving in the consumed current can be realized. It is well known that the ideal minimum energy requirement for a logic function (assuming there is no dissipation) would be the charging of the node capacitance:

$$E_c = \tfrac{1}{2} CV^2$$

For the ideal limit, the amount of energy used is independent of the switching speed for a given capacitance C. However, there is a reduction of energy if the charging voltage is reduced as follows:

$$E_{Reduced} = \tfrac{1}{2}C(V^2 - V^2_{Reduced})$$

This energy saving is enormous because it is the square root of supply voltage that governs the consumed energy, hence giving rise to significant energy savings as the supply voltage is decreased.

What is claimed is:

1. An electronic device, comprising:

a regulator for producing an operating voltage;

a semiconductor device having a minimum operating voltage and including:

a ring oscillator having an operating frequency which frequency depends on the operating voltage;

a counter for counting the operating frequency of the ring oscillator;

a comparator for comparing the operating frequency of the ring oscillator with a pre-determined frequency, which frequency represents the minimum operating voltage;

feedback means coupled to the comparator and the regulator for adjusting the operating voltage of the regulator until the frequency of the ring oscillator is substantially equal to the pre-determined frequency in order to establish the minimum operating voltage of the semiconductor.

2. The electronic device of claim 1, wherein the semiconductor comprises a micro-processor.

3. The electronic device of claim 1, wherein the c semiconductor comprises a controller.

4. The electronic device of claim 1, wherein the feedback means comprises a digital-to-analog converter.

5. In an electronic device having an operating voltage and a controller with a ring oscillator operating at a frequency, which frequency is dependent on the operating voltage, a method for establishing a minimum level of operating voltage comprising the steps of:

measuring the frequency of the ring oscillator to produce a measured frequency;

establishing an optimum frequency which represents the minimum operating voltage:

comparing the measured frequency with the optimum frequency; and adjusting the operating voltage until the measured frequency is substantially equal to the optimum frequency in order to reach the minimum level of operating voltage.

6. An electronic device, comprising:

a regulator for producing an operating voltage;

a microprocessor having an operating speed, a corresponding operating voltage and capable of executing a program routine, including:

a ring oscillator having an operating frequency, which frequency depends on the operating voltage;

a counter for counting the operating frequency of the ring oscillator;

a comparator for comparing the operating frequency of the ring oscillator with a number corresponding to the maximum operating speed of the microprocessor required to execute a particular program routine;

a memory component for storing said number; and a digital to analog converter coupled to the comparator and the regulator for adjusting the operating voltage of the regulator until the frequency of the ring oscillator is substantially equal to said stored number in order to establish the minimum operating voltage of the microprocessor.

* * * * *